US005984713A

United States Patent [19]

Hsien

[11] Patent Number: 5,984,713

[45] Date of Patent: Nov. 16, 1999

[54] TERMINATION STRUCTURE FOR MODULAR TELEPHONE PLUGS

[75] Inventor: Kuo Sheng Hsien, Taipei, Taiwan

[73] Assignees: Coble Enterprise Co., Ltd., Taipei, Taiwan; Pulse Tronics Connectors Inc., Fort Lauderdale, Fla.

[21] Appl. No.: 08/821,252

[22] Filed: Mar. 20, 1997

Related U.S. Application Data

[63] Continuation-in-part of application No. 08/425,209, Apr. 20, 1995, abandoned.

[51] Int. Cl.[6] ..... H01R 23/02; H01R 13/648

[52] U.S. Cl. ..... 439/418

[58] Field of Search ..... 439/418, 425, 439/676

[56] References Cited

U.S. PATENT DOCUMENTS 4,767,355 8/1988 Phillipson et al. ..... 439/676

*Primary Examiner*—Gary F. Paumen
*Attorney, Agent, or Firm*—Lowe Hauptman Gopstein Gilman & Berner

[57] ABSTRACT

A modular telephone plug comprises a one piece insulation housing having a hollow body with two portions, and plural contacts mounted at one end or tip thereof. A first portion accommodates a cable having an outer insulation jacket enclosing a number of individual conductors. A second portion is directly beneath the contacts. A sleeve accommodates untwisted ends of individual conductors extending from the outer insulation jacket. The sleeve is configured to be placed into the second portion to facilitate successful electrical termination of the contacts with the individual conductors accommodated within the sleeve. The sleeve enables shortening of untwisted conductor length used in the connector to a short length, such as in a range below 8 mm and preferably approximately 5 mm, to reduce Near End Cross Talk (NEXT) when data is transmitted by means of the telephone plug, particularly for connectors of Category 5 and higher. The sleeve comprises a hollow insulation element having a number of inner grooves or channels adapted to accommodate each of the individual conductors. By structuring the housing with the first and second portions, the second portion and the sleeve may be shortened. The channels are parallel to each other and in a common horizontal plane, and are aligned with corresponding contacts mounted in the housing. The sleeve includes slots or recesses directly above each of the channels to facilitate successful piercing of the individual conductors by the corresponding contacts during electrical termination.

19 Claims, 5 Drawing Sheets

TERMINATION STRUCTURE FOR MODULAR TELEPHONE PLUGS

This application is a continuation-in-part of applicants' application Ser. No. 08/425,209, filed Apr. 20, 1995, now abandoned, for A Termination Structure for Modular Telephone Plugs.

TECHNICAL FIELD

The present invention relates to telephone plugs and more particularly to a termination structure of a telephone plug connector capable of operating at high frequencies.

BACKGROUND ART

Presently known telephone plugs usually comprise an insulation housing including a plurality of contacts, the housing accommodating an electrical cable that includes an outer jacket and a number of individual conductor wires which terminate at the contacts. Each such conductor wire includes an individual conductor having its own surrounding insulation. Such wires are hereinafter referred to as "conductors". The contacts of the telephone plug pierce the surrounding insulation of respective wires to contact the conductors. For ease of notation, such a connection is hereinafter described as the contacts piercing the conductors.

When the conductors of the cable are provided as twisted pairs, in order to properly terminate each of the individual conductors of the cable it is necessary to untwist the twisted conductor pairs. Such untwisting results in a highly undesirable effect, known in the art as Near End Crosstalk (NEXT) resulting in signal disturbances at the connector.

Connectors are generally classified as having transmission speeds defined by category, with connectors operating at transmission speeds in category 3 (hereinafter Category 3connectors) having transmission characteristics specified up to 16 MHz, Category 4 connectors having transmission characteristics specified up to 20 MHz, and Category 5 connectors having transmission characteristics specified up to 100 MHz. The high frequencies at which category 5 (and higher) connectors operate result in potentially significant crosstalk, and require specific measures to be taken to meet NEXT loss standards.

NEXT loss is a measure of signal coupling from one circuit to another within a connector. NEXT loss is derived from swept frequency voltage measurements on short lengths of 100 Ω twisted-pair test leads terminated to the connector under test. In such measurements, a balanced input signal is applied to a disturbing pair of the connector while the induced signal on the disturbed pair is measured at the near-end of the test leads. In accordance with Telecommunications standard TSB40-A of the Telecommunication Industry Association/Electronic Industry Association (TIA/EIA) published in the Telecommunications Systems Bulletin, NEXT loss at any frequency f is required to meet the following limitation:

$$\mathrm{NEXT}(f) \geqq \mathrm{NEXT}(16) - 20\log(f/16),$$

where NEXT(16) is the minimum NEXT loss at 16 MHz, f is frequency in MHz in the range from 1 MHz to the highest referenced frequency, and NEXT(f) is the performance at that frequency.

To determine NEXT loss requirements for connectors of different Categories at a given frequency, the value used for NEXT(16) is 34 dB for a category 3 connector, 46 dB for a category 4 connector and 56 dB for category 5 connector.

Additionally, the above described standard establishes requirements on Return Loss, which is a measure of the degree of impedance matching between the cable and connector, derived from swept frequency voltage measurements on short lengths of 100 Ω twisted-pair test leads before and after inserting the connector under test. More specifically, it is required that, for category 4 and 5 connectors, the minimum return loss shall be 23 dB or greater for frequencies between 1 and 20 MHz. For frequencies from 20 to 100 MHz, category 5 connectors shall exhibit a minimum return loss of 14 dB or greater These return loss values are chosen to limit peak reflected voltage of 7% or less up to 20 MHz, and to 20% or less from 20 to 100 MHz.

According to the above described requirements of (TIA/EIA), the connecting hardware used for 100 UTP (Unshielded Twisted Pair) cabling shall be installed to provide minimum signal impairment by preserving wire pair twists as closely as possible to the point of mechanical termination. The amount of untwisting in a pair as a result of termination to connecting hardware shall be no greater than 13 mm (0.5 in) for category 5 cables, and no greater than 25 mm (1.0 in) for category 4 cables. This requirement is imposed to minimize untwisting of wire pair and the separation of conductors within a pair.

An additional cable management practice that should be observed to reduce untwisting of pairs is to strip back only as much cable jacket as is required to terminate on connecting hardware.

It is known that many professionals have mistakenly specified the above noted 13 mm standard as a requirement for UTP cable jacket removal. However, the available configurations of connector hardware termination structures does not permit significant reductions of untwisted pair length below the 13 mm maximum.

It is thus an object of the present invention to provide a termination structure for a telephone connector which allows reduction of the amount of wire that is untwisted for termination below the 13 mm maximum value, to lengths as short as slightly more than 2.5 mm, and thus to provide significant reduction in the near end crosstalk experienced at the connector even for data transmission rates of 100 MHz and greater.

It is a more specific object of the invention to provide a termination structure requiring a length of untwisted wire which is approximately 5 mm, thus to permit the structure to be used in Category 3, Category 4, Category 5, and higher Categories as defined in the industry.

It is yet another object of the invention to provide a termination structure having a first region which has internal dimensions that are sufficiently large to acccept a jacketed cable therein and extending to within a short distance of contacts for the conductors, a second region having smaller internal dimensions than the first region for receiving therein the unjacketed cable conductors and extending only the short distance between the end of the jacketed cable and the contacts, and a short, rigid sleeve fitting within the short distance of the second region and accepting a short length of the untwisted conductor wires to enable positioning of such a short length of wire for making electrical contact with external contacts therefor.

It is a more specific object of the invention to provide such a structure wherein the short length of untwisted conductor wires is less than 13 mm.

It is still a more specific object of the invention to provide such a structure wherein the short length of untwisted conductor wires is in a range of 3 to 8 mm.

Still a more specific object of the invention is to provide a terminating structure wherein the short length of the untwisted conductor wires is approximately 5 mm.

It is yet another object of the invention to provide a terminating structure wherein the short distance of the second region and of the sleeve is less than 13 mm.

It is still another object of the invention to provide a terminating structure wherein the short distance of the second region and of the sleeve is in a range of 3 to 8 mm.

It is still another object of the invention to provide a terminating structure wherein the short distance of the second region and of the sleeve is approximately 5 mm.

It is a further object of the invention to provide a Category 5 connector having a terminating structure which accepts untwisted conductor pairs of a jacketed cable having a length of approximately 5 mm, thus to reduce or eliminate Near End Crosstalk (NEXT) therebetween when data is transferred at a frequency of 100 MHz and greater.

It is yet a more specific object of the invention to provide a terminating structure for a telephone connector having a first region for receiving a portion of jacketed cable, and only a single region with substantially a parallelopiped shape for receiving therein unjacketed cable conductors and a short, rigid sleeve having a shape which is substantially a parallelopiped, the sleeve being substantially fully enclosed in the single region and accepting a short length of untwisted conductor wires for making electrical contact with external contacts therefor.

It is still another object of the invention to provide a terminating structure for a category 5 telephone connector which includes a short region having a substantially parellelopiped shape for fully receiving therein a short sleeve, having a substantially parallelopiped shape and guiding a short portion of conductor wires to external contacts therefor, while retaining a larger region for receiving a section of the jacketed cable and including a strain relief for the cable in the larger region.

DISCLOSURE OF INVENTION

Broadly, the present invention comprises a modular telephone plug comprising:

an insulation housing provided with a number of contacts mounted at one end or tip of said housing, said housing having a hollow body comprising two portions, wherein a first of said two portions is adapted to accommodate a cable comprising an outer insulation jacket enclosing a number of individual conductors;

a sleeve or liner provided to accommodate ends of said individual conductors extending from said outer insulation jacket;

said sleeve is adapted to be placed into a second portion of said housing directly underneath of said contacts to facilitate successful electrical termination of said contacts with said individual conductors accommodated within said sleeve, wherein said sleeve is provided to at least reduce or eliminate near end cross talk when data is transmitted by means of said telephone plug.

In another embodiment of the present invention, said sleeve comprises a hollow insulation element having a number of inner grooves or channels adapted to accommodate each of said individual conductors. Said channels are positioned parallel to each other and are aligned with the corresponding contacts mounted in said housing, and said channels are positioned in the same horizontal plan.

In yet another embodiment, said sleeve further comprises slots or recesses formed directly above each of said channels; said slots are provided to facilitate successful piercing of said individual conductors by means of said corresponding contacts during electrical termination. Each end of said individual conductors is completely accommodated within said sleeve, and wherein in assembled position, said sleeve is abutting or flush against the tip of said housing.

In still another embodiment, said contacts comprising a number of blade-shaped elements mounted near the tip of said plug in vertical position, wherein upper edges of said contacts are adapted to be mated with corresponding female jack, and wherein lower edges of said contacts are adapted to be electrically terminated with the corresponding individual conductors. Said housing further comprising a strain relief element adapted to securely grip the outer insulation jacket inside of said housing to eliminate any undesirable sliding of said cable out of said housing.

In yet another embodiment of the present invention, said strain relief element is an integral part of said housing, and said housing further comprises a metal shield mounted around said housing to prevent an electro-magnetic interferences. Said housing and said sleeve are made of polycarbonate material or the like.

These and other objects, features and advantages of the present invention will become readily apparent to those skilled in the art from the following description, and drawings, wherein there is shown and described a preferred embodiment of the invention, simply by way of illustration and not of limitation of one of the best modes (and alternative embodiments) suited to carry out the invention. The invention itself is set forth in the claims appended hereto. As will be realized upon examination of the specification and drawings and from practice of the same, the present invention is capable of still other, different, embodiments and its several details are capable of modifications in various obvious aspects, all without departing from the scope of the invention as recited in the claims. Accordingly, the drawings and the descriptions provided herein are to be regarded as illustrative in nature and not as restrictive of the invention.

BRIEF DESCRIPTION OF THE DRAWING

The accompanying drawings, incorporated into and forming a part of the specification, illustrate several aspects of a preferred embodiment of the present invention and, together with the description, serve to explain the principles of the invention. In the drawings.

BEST MODE FOR CARRYING OUT THE INVENTION

Figure 9:
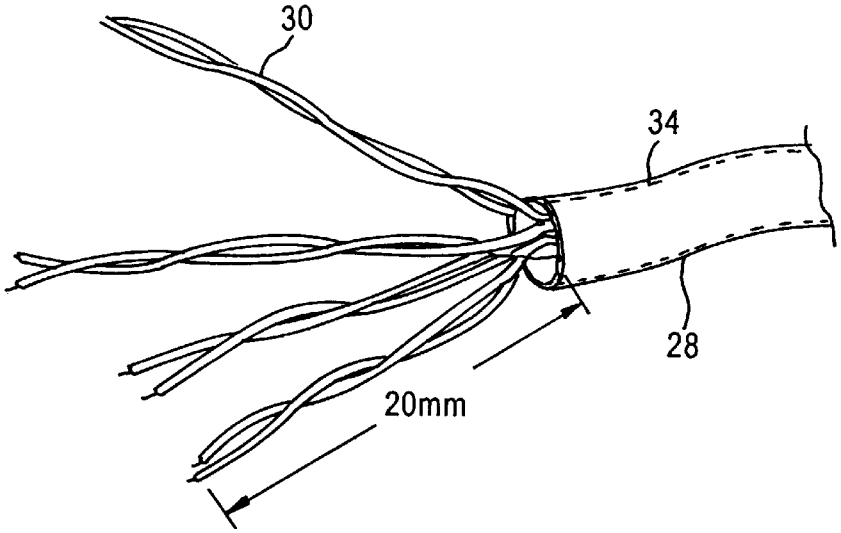
FIG. 9 is a perspective view of twisted pair cable.
Figure 10:
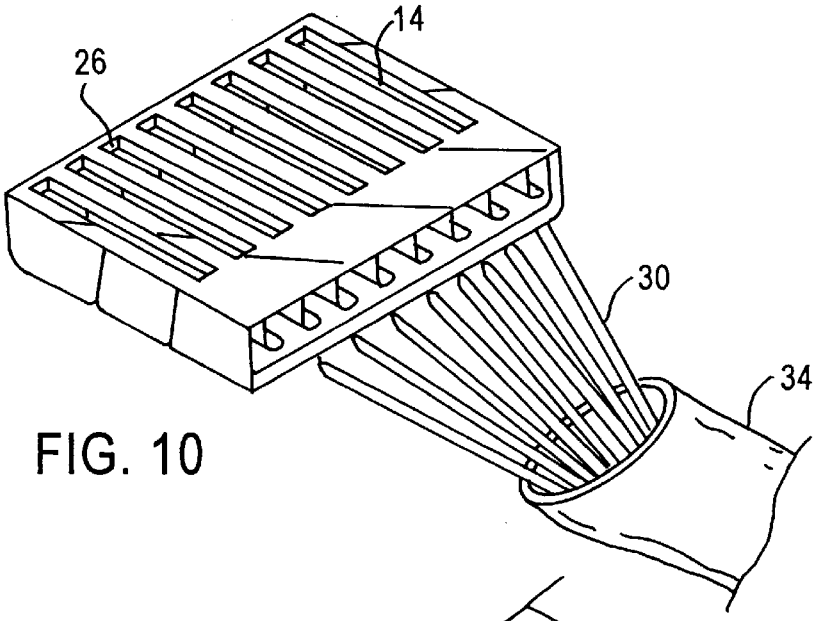
FIG. 10 is a perspective view of the sleeve showing the first step of plug assembly.
Figure 11:
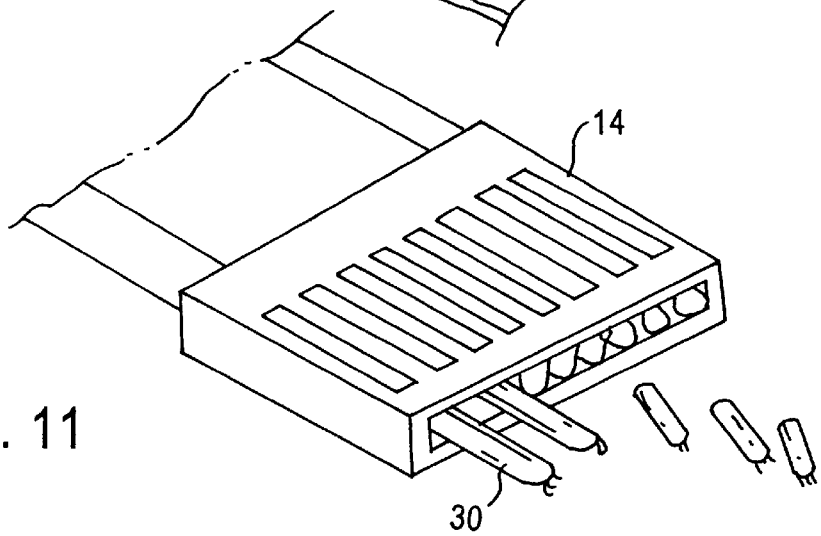
FIG. 11 is a perspective view of the sleeve with individual conductor being placed within sleeve.
Figure 12:
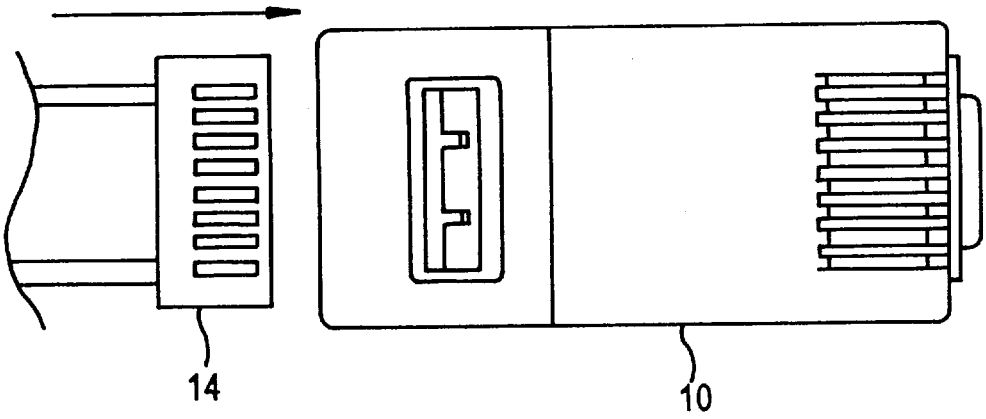
FIG. 12 is a top view of assembly before the sleeve is inserted into the housing.

As shown on FIGS. 1 to 4 the present invention comprises an insulation housing 10 having a hollow body provided with two portions 20 and 22. As shown on FIG. 1, portion 20 is large enough to accommodate a cable, shown in FIG. 9, having an outer insulation jacket 34 and individual conductors 30. Second portion 22 of the housing 10 is smaller than the first portion, and is provided to accommodate an insulation sleeve 14 shown on FIGS. 5 to 7. As will be appreciated from FIGS. 1 and 4, the shape of second portion 22 is substantially that of a parallelopiped, having a length L, a width W, and a height H, thus providing self guiding and positioning of the sleeve therein.

The front portion or tip of the housing 10 is provided with a number of contacts 12 embedded into the housing 10. Each of the contacts 12 has a blade-shaped configuration and is mounted near the tip of the housing 10. The contacts are seen to have a two point structure, wherein two contact points are separated by a distance D. In typical contacts used in prior art connectors, the distance D may be approximately 2.5 mm.

The housing 10 also comprises a latching mechanism 16 provided to securely hold the plug inside a female jack and a strain relief element 18 integrally formed in the housing 10. This strain relief element 18, which engages the cable in the first portion 20, is thus internal to the first portion and securely grips the outer insulation jacket 34 within the housing 10, thus avoiding the need for separate external strain relief structures.

Figure 7:
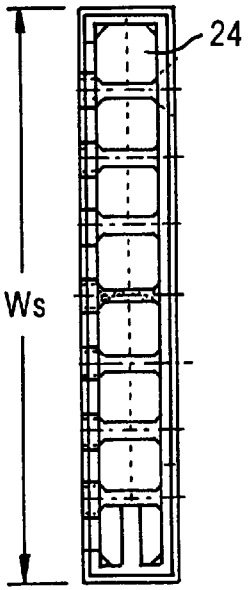
FIG. 7 is a back view of FIG. 5 showing a number of inner grooves or channels.
Figure 5:
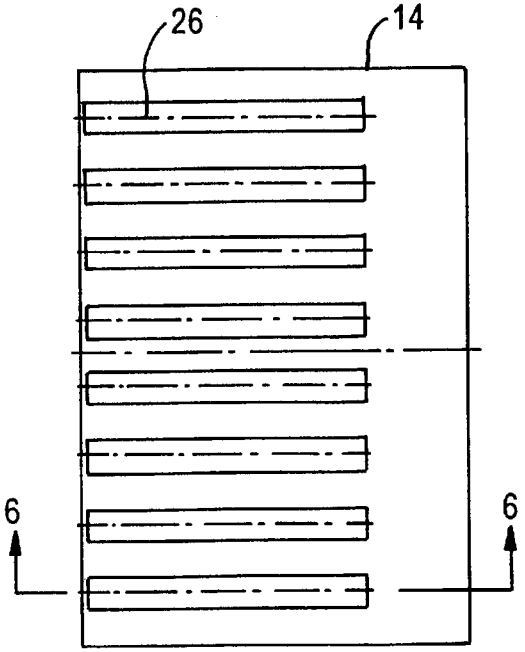
FIG. 5 is a top view of a sleeve according to the present invention.
Figure 6:
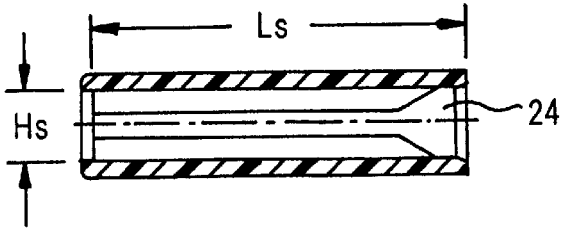
FIG. 6 is a cross-sectional view of FIG. 5 taken along the lines A—A.

As shown in FIGS. 5 to 7, insulation sleeve 14 is adapted to accommodate ends of individual conductors 30 of the cable. The sleeve 14 comprises an elongated hollow body provided with a number of inner grooves or channels 24 positioned parallel to each other. Sleeve 14 has width, length and height dimensions of Ws, Ls and Hs, respectively, and has a substantially parallelopiped shape matching that of second portion 22 of housing 10. That is, the sleeve dimensions Ws≈W, Ls≈L, and Hs≈H, differing from the dimensions of the second portion sufficiently to provide manufacturing tolerance and to permit sufficient clearance for snugly fitting the sleeve within the second portion. It will be appreciated that the actual numerical dimensions of the sleeve may vary inasmuch as, while the external dimensions of housing 10 are standardized, the internal dimensions of portion 22 may vary.

To the extent that a confining structure for accepting portions of cable conductors within a connector has been described in the prior art, as exemplified by Su et al., U.S. Pat. No. 5,505,638, and that with the guidance of the present disclosure such a structure could be modified for use as contemplated herein, the resulting structure of the prior art has been made more complicated and requires more complex fabrication and assembly. For example, in such prior art the housing cannot be made as a single, one-piece, structure into which the confining structure may be easily inserted. Instead, the housing is formed as two separate pieces, the confining structure is a third piece of the connector, and includes a platform along with the wire confining portion thereof. It is thus necessary to form carefully aligned guide holes in the various portions of the connector, to align the three pieces for assembly, and to insert aligning pins in the guide holes provided for the purpose. Moreover, a strain relief member is removed from the interior of the connector and placed externally thereto, thus requiring yet another step in positioning the jacketed cable therein prior to compressing the member about the cable.

Thus, such prior art structures are more expensive to manufacture and to assemble, and are impractical where simplicity of assembly and expense are a consideration. The present invention, by providing a one-piece housing and a simple sleeve structure, thus permits inexpensive manufacture, as well as simple and less costly assembly than the prior art.

Figure 13:
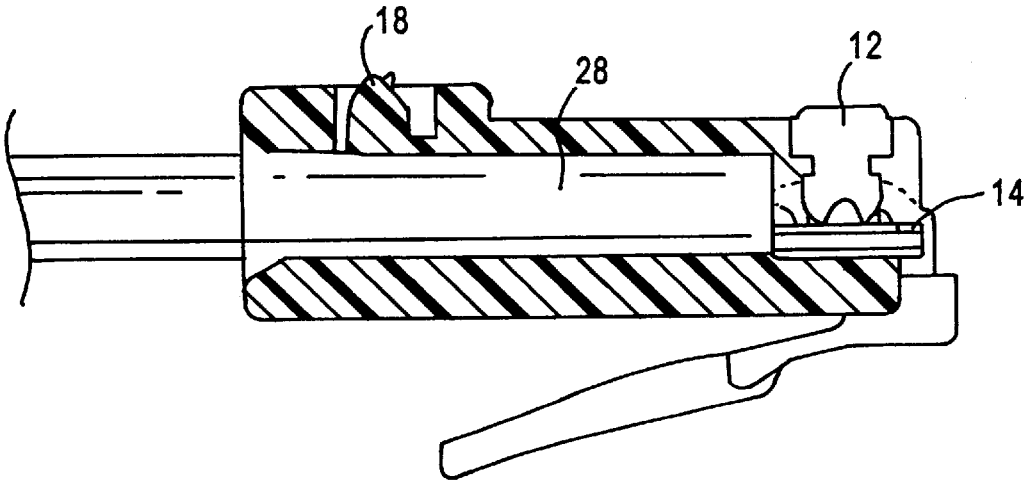
FIG. 13 is a cross-sectional side view of the completed assembly.

For example, when sleeve 14 of the inventive structure is inserted into the second portion 22 of the housing 10, channels 24 are aligned with the corresponding contacts 12 mounted in said housing 10. An upper surface of the sleeve 14 comprises slots or recesses 26 formed directly above each of the channels 24. The slots 26 are provided to facilitate successful piercing of the individual conductors 30 by the corresponding contacts 12 during electrical termination without requiring separate alignment steps. It will be appreciated that, in the inventive device, each end of the individual conductors 30 is completely accommodated within the sleeve 14, and that in the assembled position shown in FIG. 13 the sleeve 14 is flush against the tip of the housing 10. Upper edges of contacts 12 are adapted to mate with the corresponding female jack, and lower edges are electrically terminated with the corresponding conductors 30.

By providing matching dimensions of the sleeve and the second portion of the housing as hereinabove described, in its assembled position the sleeve 14 is positioned directly beneath contacts 12 to facilitate successful electrical termination of the contacts with the individual conductors 30 accommodated within sleeve 14 through the slots of sleeve 14. Normally there are four twisted pairs of individual conductors in a cable and the sleeve 14 includes eight corresponding grooves for those conductors 30.

In accordance with a significant aspect of the invention, it is possible to minimize the length L of portion 22 and the sleeve length Ls, and thus to obtain improved NEXT Loss and reduced NEXT. From FIG. 13, which shows the structure assembled with the cable therein, it is seen that sleeve 14 contains substantially the entire length of the untwisted conductor wires of the cable. As has been described hereinabove, in order to meet standards for Category 5 connectors, the length of untwisted wire should not exceed 13 mm. Accordingly, housing 10 is configured to have a length L of portion 22 which is less than 13 mm and sleeve 14 is formed to have a similar length Ls of no more than 13 mm.

However, while in the prior art it has generally been accepted to provide untwisted conductors of a 13 mm length, it is a feature of the present invention that the length of untwisted conductor is made significantly shorter than the permissible value. Indeed, the above described configuration of housing 10 permits sleeve 14 to be almost as short as the separation distance D of the contact points of contacts 12. For structural rigidity, however, and in view of the slots 26 formed in its upper surface, it will be appreciated that the sleeve length Ls will exceed separation distance D by some increment in accordance with the characteristics of the sleeve materials. The amount of the minimum increment will vary with the material in a manner well understood and determinable by one of ordinary skill in the art.

Thus, as newer and more rigid materials are developed and become available for use as sleeve 14, it will be possible for sleeve length Ls to approach the separation distance D more and more closely (i.e., for the increment to become smaller and smaller). For improved characteristics over the prior art, it is preferred that the sleeve length Ls be shorter than 8 mm, e.g., in the range of 3 mm–8 mm. In a specifically preferred embodiment, sleeves of length Ls≈5 mm have been produced and tested. For such sleeves, in one experiment the test results were as follows:

| | NEXT Loss (dB) at 100 MHz | |
|---|---|---|
| Pin Combination | TEST | MIN |
| 4 & 5–3 & 6 | 40.99 | 40 |
| 3 & 6–1 & 2 | 48.64 | 45 |
| 3 & 6–7 & 8 | 45.98 | 45 |
| 4 & 5–1 & 2 | 58.10 | 55 |
| 4 & 5–7 & 8 | 63.04 | 55 |
| 1 & 2–7 & 8 | 57.22 | 55 |

When compared with the minimum requirements of the standard, these results demonstrate that for those pin combinations requiring the highest separation (highest NEXT Loss), the inventive structure unexpectedly provides losses ranging from 2.22 dB to 8.04 dB greater over minimum requirements—a significant improvement.

Figure 4:
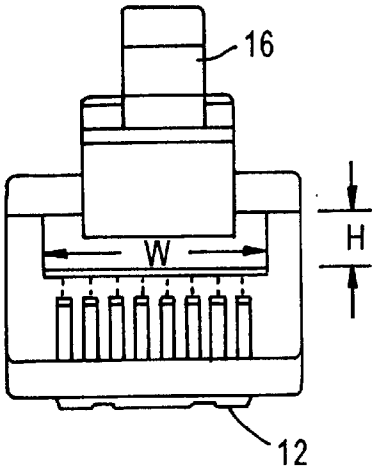
FIG. 4 is a front view of insulation housing.
Figure 1:
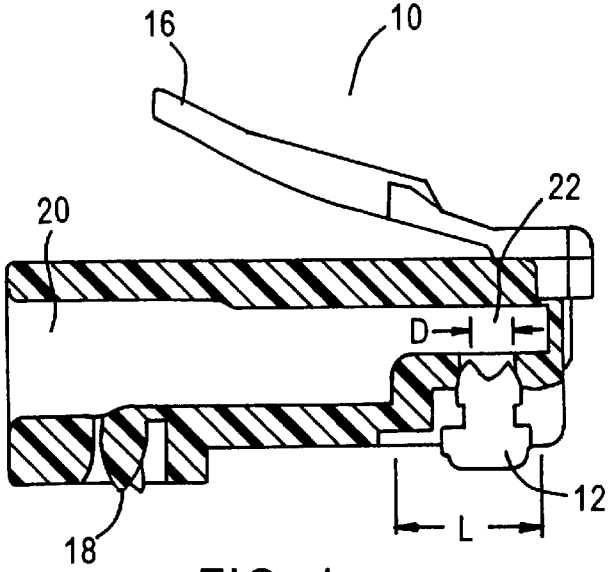
FIG. 1 is a side cross-sectional view of the insulation housing of the present invention.
Figure 2:
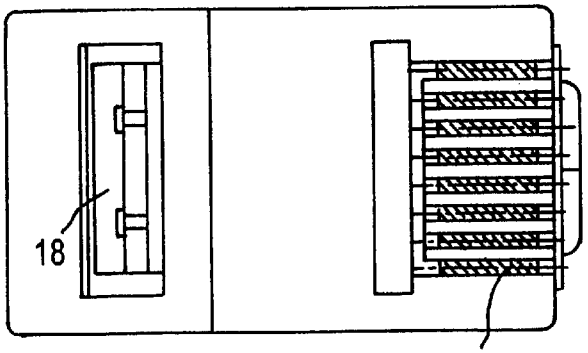
FIG. 2 is a top view of the insulation housing of the present invention.
Figure 3:
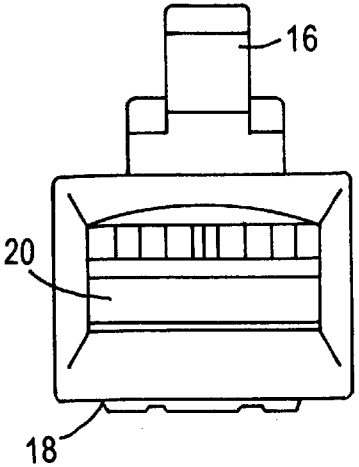
FIG. 3 is a back view of the insulation housing.
Figure 8:
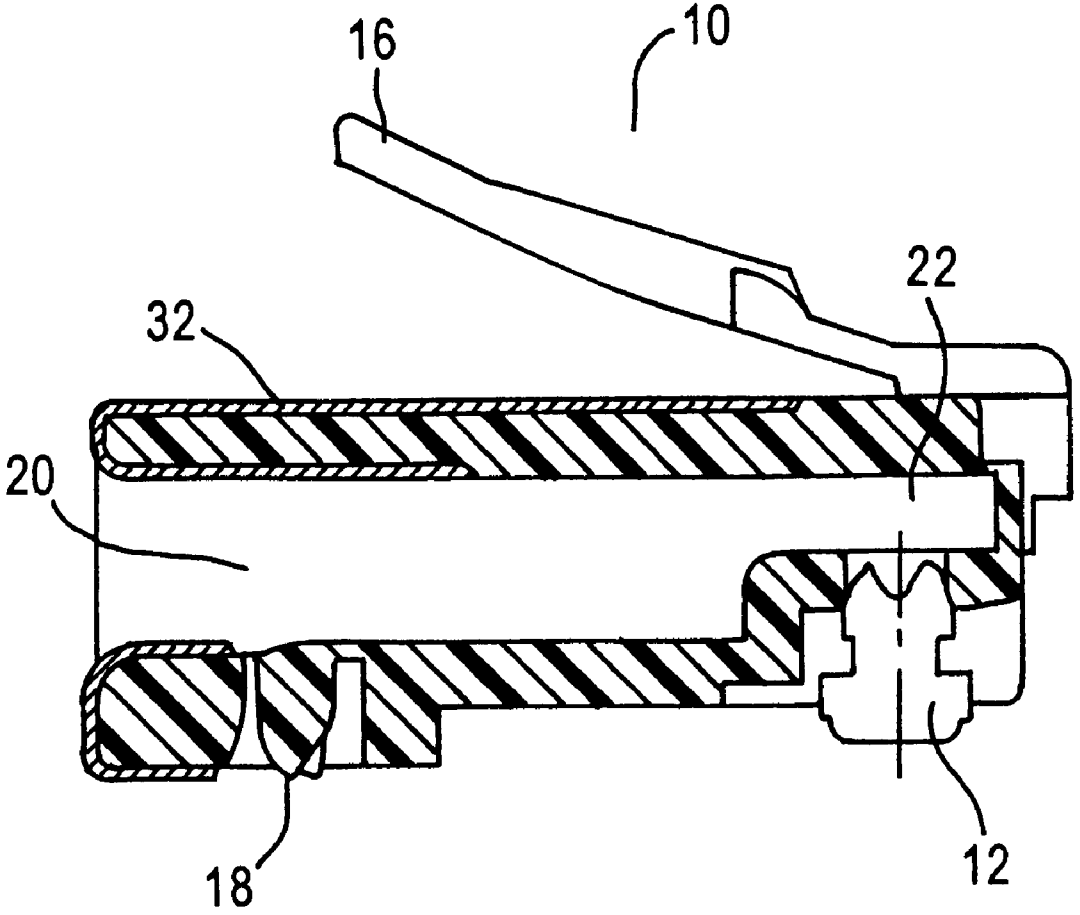
FIG. 8 is a side cross-sectional view of the insulation housing as of FIG. 1 provided with the metal shield.

Another embodiment shown in FIG. 8 is similar to FIG. 1, except that the housing 10 is additionally provided with a metal shield 32 mounted around the housing 10 and provided to prevent electromagnetic interferences.

Preferably, the housing 10 and sleeve 14 are made of polycarbonate material. Providing insulating material in the sleeve further cuts down cross talk. As new materials become available, such materials may be used to form the sleeve for various reasons. For example, when such new materials are found to exceed the rigidity or other characteristics of polycarbonate, the new materials may permit shortening of both the lengths L and Ls, thus providing an improvement in increasing NEXT Loss and still further reduction of NEXT.

FIGS. 9 to 12 illustrate assembly procedure of the present invention including the following steps:

stripping the outer jacket 34 of the cable 28 for a length of approximately 20 mm;

untwisting the individual conductors 30 and inserting them into the sleeve 14;

cutting the excess conductor from the front of the sleeve;

inserting the assembled sleeve 14 and cable 28 into the one-piece housing 10, wherein the matching dimensions (and shapes) of sleeve 14 and portion 22 enable the sleeve to be positioned directly under the contact blades 12;

terminating the completely assembled plug by means of a hand tool, or an auto-termination tool (not shown), thus completing the operation.

It will thus be appreciated that a significant advantage of the present invention lies in reduction of the amount of untwisted wire used in the termination, enabling reduction or elimination of Near End Crosstalk (NEXT) when data is transferred at a frequency of 100 MHz corresponding to Category 5 connectors (or at higher frequencies, as different standards are developed for still higher Categories of connectors). Moreover, the inventive structure permits simplified manufacture and assembly of the connector. The invention is not restricted to Category 5 connectors however, and may be used for other modifications or categories of similar connectors. For example, the structure may be used in connectors of Categories lower than 5, in conjunction with unstandardized connectors, in conjunction with connectors meeting standards developed in the future, or in other terminating devices.

The foregoing description of the preferred embodiment of the invention has been presented for purposes of illustration and description. It is not intended to be exhaustive or to limit the invention to the precise forms disclosed, since many modifications or variations thereof are possible in light of the above teaching. For example, the internal shape of portion 22 and the shape of sleeve 14 may be other than that of a parallelopiped. Other self guiding shapes may be used, as may cylindrical shapes having guiding notches and projections. All such modifications and variations are within the scope of the invention. The embodiments described herein were chosen and described in order best to explain the principles of the invention and its practical application, thereby to enable others skilled in the art to utilize the invention in various embodiments and with various modifications as are suited to the particular use contemplated therefor. It is intended that the scope of the invention be defined by the claims appended hereto, when interpreted in accordance with the full breadth to which they are legally and equitably entitled.

I claim:

1. A modular telephone plug comprising:

a one-piece insulation housing provided with a number of contacts mounted at one end or tip thereof, said housing having a hollow body comprising first and second portions, said first portion of said housing adapted to accommodate a cable and an outer insulation jacket enclosing a number of individual conductors therein;

a sleeve for accommodating bare ends of said individual conductors extending from said outer insulation jacket;

said second portion of said housing and said sleeve having substantially equal lengths, said second portion of said housing adapted to accept said sleeve therein and to position said sleeve substantially only beneath said contacts to facilitate successful electrical termination of said contacts with said individual conductors accommodated within said sleeve, wherein said first portion extends to said second portion beneath said contacts, thereby to extend said cable and said jacket substantially to said second portion beneath said contacts and to reduce near end cross talk when data is transmitted by means of said telephone plug, said housing further comprising, as an integral part thereof, a strain relief element adapted to securely grip the outer insulation jacket inside of said housing to eliminate any undesirable sliding of said cable out of said housing.

2. A modular telephone plug comprising:

an insulation housing provided with a number of contacts mounted at one end or tip of said housing, said housing having a hollow body comprising first and second portions, said first portion of said housing configured to accommodate a cable and an outer insulation jacket enclosing a number of individual conductors therein;

a sleeve for accommodating substantially the entirety of ends of said individual conductors extending from said outer insulation jacket;

said second portion of said housing configured for accepting therein said sleeve beneath said contacts to facilitate successful electrical termination of said contacts with said individual conductors accommodated within said sleeve, said second portion and said sleeve having mating shapes and corresponding dimensions, said sleeve being enclosed within said second portion in its entirety, said sleeve and said second portion each having a length less than 13 mm, said first portion extending to said second portion beneath said contacts, thereby to extend said cable and said jacket enclosing said conductors substantially to said second portion beneath said contacts to reduce near end cross talk when data is transmitted by means of said telephone plug, said sleeve comprising a hollow insulation element having a number of inner channels adapted to accommodate each of said individual conductors.

3. Plug according to claim 2, wherein said sleeve and said second portion have substantially equal lengths in a range between 3 mm and 8 mm.

4. Plug according to claim 2, wherein said sleeve and said second portion have substantially equal lengths of approximately 5 mm.

5. Plug according to claim 4, wherein said second portion and said sleeve have substantially parallelopiped shapes.

6. Plug according to claim 3, wherein said channels are positioned parallel to each other and are aligned with the corresponding contacts mounted in said housing.

7. Plug according to claim 6, wherein said channels are positioned in a common horizontal plane.

8. Plug according to claim 7, wherein said sleeve further comprises slots formed directly above each of said channels to facilitate successful piercing of said individual conductors by said corresponding contacts during electrical termination.

9. Plug according to claim 3, wherein each end of said individual conductors is completely accommodated within said sleeve and wherein in assembled position said sleeve is abutting or flush against the top of said housing.

10. Plug according to claim 3, wherein said contacts comprise a number of blade-shaped elements mounted near the tip of said plug in vertical position, wherein upper edges of said contacts are adapted to be mated with a standard female jack corresponding thereto, and wherein lower edges of said contacts are adapted to be electrically terminated with the corresponding individual conductors.

11. Plug according to claim 3, wherein said housing and said sleeve are made of polycarbonate material and said housing further comprises a metal shield mounted around said housing to prevent electromagnetic interference.

12. A modular telephone plug comprising:

an insulation housing provided with a plurality of contacts mounted at one end or tip of said housing, said housing having a one piece hollow body comprising two portions, a first of said two portions accommodating a cable including a plurality of individual conductors and an outer insulation jacket enclosing the conductors;

a sleeve for accommodating ends of the individual conductors extending from the outer insulation jacket, thereby to facilitate successful electrical termination of said contacts with the individual conductors accommodated within said sleeve;

a second of said two portions being positioned below and only in an immediately adjacent vicinity of said contacts for accommodating said sleeve below and immediately adjacent to said contacts, wherein said first portion extends to said second portion beneath said contacts, thereby to extend said cable and said jacket substantially to said second portion beneath said contacts to reduce near end cross talk when data is transmitted by means of said telephone plug;

said sleeve comprising a short hollow insulation element having a number of inner channels therein for accommodating the individual conductors, said channels extending along an entire length of said sleeve, said channels positioned parallel to each other and correspondingly aligned with said contacts mounted in said housing, said channels having a length less than 13 mm and being sufficiently short to retain the parallel individual conductors only in said second portion below and immediately adjacent said contacts, thereby to reduce a near end cross talk.

13. A modular telephone plug as recited in claim 12, wherein said sleeve further comprises slots directly above each of said channels, said slots extending over less than an entire length of said channels thereby to provide rigidity for said sleeve, said channels each having a length in a range between 3 mm and 8 mm.

14. A modular telephone plug according to claim 13 wherein said insulation housing is a one-piece housing.

15. A modular telephone plug comprising:

a one-piece insulation housing provided with a plurality of contacts mounted at one end or tip of said housing, said housing having a hollow body comprising two portions, a first of said two portions accommodating a cable including a plurality of individual conductors and an outer insulation jacket enclosing the conductors;

a sleeve for accommodating ends of the individual conductors extending from the outer insulation jacket, thereby to facilitate successful electrical termination of said contacts with the individual conductors accommodated within said sleeve;

a second of said two portions being positioned below and only in an immediately adjacent vicinity of said contacts for accommodating substantially an entirety of said sleeve below and immediately adjacent to said contacts, wherein said first portion extends to said second portion beneath said contacts, thereby to extend said cable and said jacket substantially to said second portion beneath said contacts to reduce near end cross talk when data is transmitted by means of said telephone plugs, said sleeve comprising a hollow insulation element less than 13 mm long and having a number of inner channels therein for accommodating the individual conductors, said channels extending along an entire length of said sleeve, said channels positioned parallel to each other and correspondingly aligned with said contacts mounted in said housing, said channels retaining the parallel individual conductors only in said second portion below and immediately adjacent said contacts, thereby to reduce a near end cross talk, further comprising a strain relief element within said first portion of said housing and adapted to securely grip the outer insulation jacket inside of said housing to reduce undesirable sliding of said cable out of said housing, said strain relief element separated from said one end or tip of said housing by a first distance and separated by a predetermined distance from said second portion, the cable and the jacket extending beyond the strain relieve element by said predetermined distance to said second portion and to said channels of said sleeve.

16. A modular telephone plug as recited in claim 15, wherein said second portion and said sleeve have mating shapes and dimensions, said sleeve having a length in a range between 2 mm and 8 mm.

17. A modular telephone plug as recited in claim 16, wherein said sleeve further comprises slots directly above each of said channels, said slots extending over less than an entire length of said channels thereby to provide rigidity for said sleeve, said sleeve having a length of approximately 5 mm.

18. A modular telephone plug as recited in claim 17, wherein said sleeve and said second portion extend from said one end or tip of said housing by less than said predetermined distance towards said strain relieve element, whereby said strain relieve element is at least twice as far from said one end or tip of said housing as said sleeve and said second portion.

19. A modular telephone plug as recited in claim 18, wherein said channels are in the same horizontal plane.

* * * * *